US007955412B2

(12) United States Patent
Osmundson

(10) Patent No.: US 7,955,412 B2
(45) Date of Patent: Jun. 7, 2011

(54) METHOD FOR PRODUCING AGGLOMERATED MATERIAL

(75) Inventor: Mike Osmundson, Silver Bay, MN (US)

(73) Assignee: Mesabi Nugget LLC, Silver Bay, MN (US)

( * ) Notice: Subject to any disclaimer, the term of this patent is extended or adjusted under 35 U.S.C. 154(b) by 0 days.

(21) Appl. No.: 12/294,244

(22) PCT Filed: Mar. 24, 2006

(86) PCT No.: PCT/US2006/011096

§ 371 (c)(1),
(2), (4) Date: Jul. 29, 2009

(87) PCT Pub. No.: WO2007/123512

PCT Pub. Date: Nov. 1, 2007

(65) Prior Publication Data

US 2010/0005928 A1 Jan. 14, 2010

(51) Int. Cl.
*C22B 1/14* (2006.01)

(52) U.S. Cl. ..... 75/484; 75/771; 75/772; 423/138

(58) Field of Classification Search ..... 75/772
See application file for complete search history.

(56) References Cited

U.S. PATENT DOCUMENTS 2,996,372 A 8/1961 Imperato, Jr.
3,323,901 A 6/1967 Dahl et al.
6,497,746 B1 * 12/2002 Steeghs et al. ..... 75/772
6,579,505 B2 6/2003 Tsuchiya et al.
6,811,759 B2 * 11/2004 Tsuchiya et al. ..... 423/138
2004/0020326 A1 * 2/2004 Ibaraki et al. ..... 75/313
2004/0221426 A1 * 11/2004 Igawa et al. ..... 23/314
2006/0218753 A1 10/2006 Igawa et al.

FOREIGN PATENT DOCUMENTS

CN 1473204 A 2/2004
EP 0 916 742 A1 5/1999

(Continued)

OTHER PUBLICATIONS

Taiwanese Search Report issued Sep. 30, 2010, in Patent Application No. 096104557, filed Feb. 8, 2007 (with partial English-language translation).

(Continued)

*Primary Examiner* — George Wyszomierski
*Assistant Examiner* — Tina M. McGuthry-Banks
(74) *Attorney, Agent, or Firm* — Oblon, Spivak, McClelland, Maier & Neustadt, L.L.P.

(57) ABSTRACT

A method is provided for producing an agglomerated material that is used for producing metallic iron by heat reduction in a moving hearth-type reducing furnace, wherein the agglomerated material can have a high mechanical strength without increases in the binder content and the moisture content of the material mixture. The method for producing an agglomerated material used for producing metallic iron, wherein the agglomerated material is produced by agglomerating a material mixture containing an iron-oxide-containing material, a carbonaceous reducing agent, a binder, and moisture; drying the material mixture; and charging and heating the material mixture in a moving hearth-type reducing furnace to reduce the iron oxide contained in the material mixture with the carbonaceous reducing agent, wherein a carbohydrate is used as the binder and the material mixture is left to stand prior to the agglomeration.

24 Claims, 2 Drawing Sheets

FOREIGN PATENT DOCUMENTS

| | | | |
|---|---|---|---|
| JP | 61-201740 | | 9/1986 |
| RU | 98104864 | | 9/1999 |
| RU | 2177044 | C2 | 12/2001 |
| SE | 217975 | | 1/1968 |
| SU | 529245 | | 11/1976 |
| SU | 675081 | | 7/1979 |
| SU | 1643623 | A1 | 4/1991 |
| TW | 11-193423 | | 7/1999 |
| TW | 565617 | | 12/2003 |

OTHER PUBLICATIONS

Office Action issued Aug. 12, 2010, in Chinese Patent Application No. 200680053986.2.

* cited by examiner

METHOD FOR PRODUCING AGGLOMERATED MATERIAL

CROSS-REFERENCE TO RELATED APPLICATIONS

This application is a 371 of PCT/US06/11096 filed Mar. 24, 2006.

TECHNICAL FIELD

The present invention relates to methods for producing agglomerated materials that are used for producing metallic iron in moving hearth-type reducing furnaces, and in particular, relates to methods for producing agglomerated materials whose mechanical strength is increased.

BACKGROUND ART

A method has been developed for iron-making in which metallic iron is produced by solid reduction by heating a material mixture containing an iron-oxide-containing material (iron source) such as iron ore and a carbonaceous reducing agent such as coal in a moving hearth-type reducing furnace. The material mixture used in the method is compressed into a simple compact or is agglomerated into a compact such as a pellet or a briquette, and then the resulting compact is charged into the moving hearth-type reducing furnace. When the material mixture is agglomerated, moisture is added to the material mixture to enable ready agglomeration. However, the strength of the compact is decreased with an increase in the moisture content. Thus, the stability in heat reduction operation is deteriorated. Additionally, when the moisture content of the compact is large, the rate of increase of the compact temperature in the moving hearth-type reducing furnace is decreased; which decreases the rate of reduction of iron oxide. Therefore, the compact mixed with moisture is previously dried into an agglomerated material prior to the charging of the compact into the moving hearth-type reducing furnace.

Additionally, in order to improve the handleability, the strength of the agglomerated compact is increased by blending various binders, such as slaked lime, bentonite, and carbohydrates, with the above-mentioned mixture (See, claims in Japanese Unexamined Patent Application Publication No. 11-193423). Since the strength of the agglomerated material increases in some proportion to the amount of binder, a large amount of binder is used in order to increase the strength of the agglomerated material. However, the use of a large amount of binder causes an increase in raw-material cost. Consequently, it is required that the binder content is reduced as much as possible.

Furthermore, if the moisture content when the material mixture is formed is constant, the relative content of moisture decreases with an increase in the binder content. This causes deterioration of the formability. Therefore, the moisture content is required to be increased with the binder content. However, this elongates the drying time. Thus, the production efficiency is decreased.

The present invention has been accomplished under such circumstances and an object of the present invention is to provide a method for producing an agglomerated material that is used for producing metallic iron by heat reduction in a moving hearth-type reducing furnace, wherein the agglomerated material can have a high mechanical strength without increases in the binder content and the moisture content of the material mixture.

DISCLOSURE OF INVENTION

In a method according to the present invention, an agglomerated material used for producing metallic iron is produced by agglomerating a material mixture containing an iron-oxide-containing material, a carbonaceous reducing agent, a binder, and moisture; drying the material mixture; and charging and heating the material mixture in a moving hearth-type reducing furnace to reduce the iron oxide contained in the material mixture with the carbonaceous reducing agent, wherein a carbohydrate is used as the binder and the material mixture is left to stand prior to the agglomeration.

According to the present invention, the strength of the agglomerated material can be increased by specifying the kind of the binder that is blended to the material mixture and by subjecting the material mixture to a simple process, i.e., leaving the material mixture standing for aging, prior to the agglomeration of the material mixture.

BEST MODE FOR CARRYING OUT THE INVENTION

Figure 1:
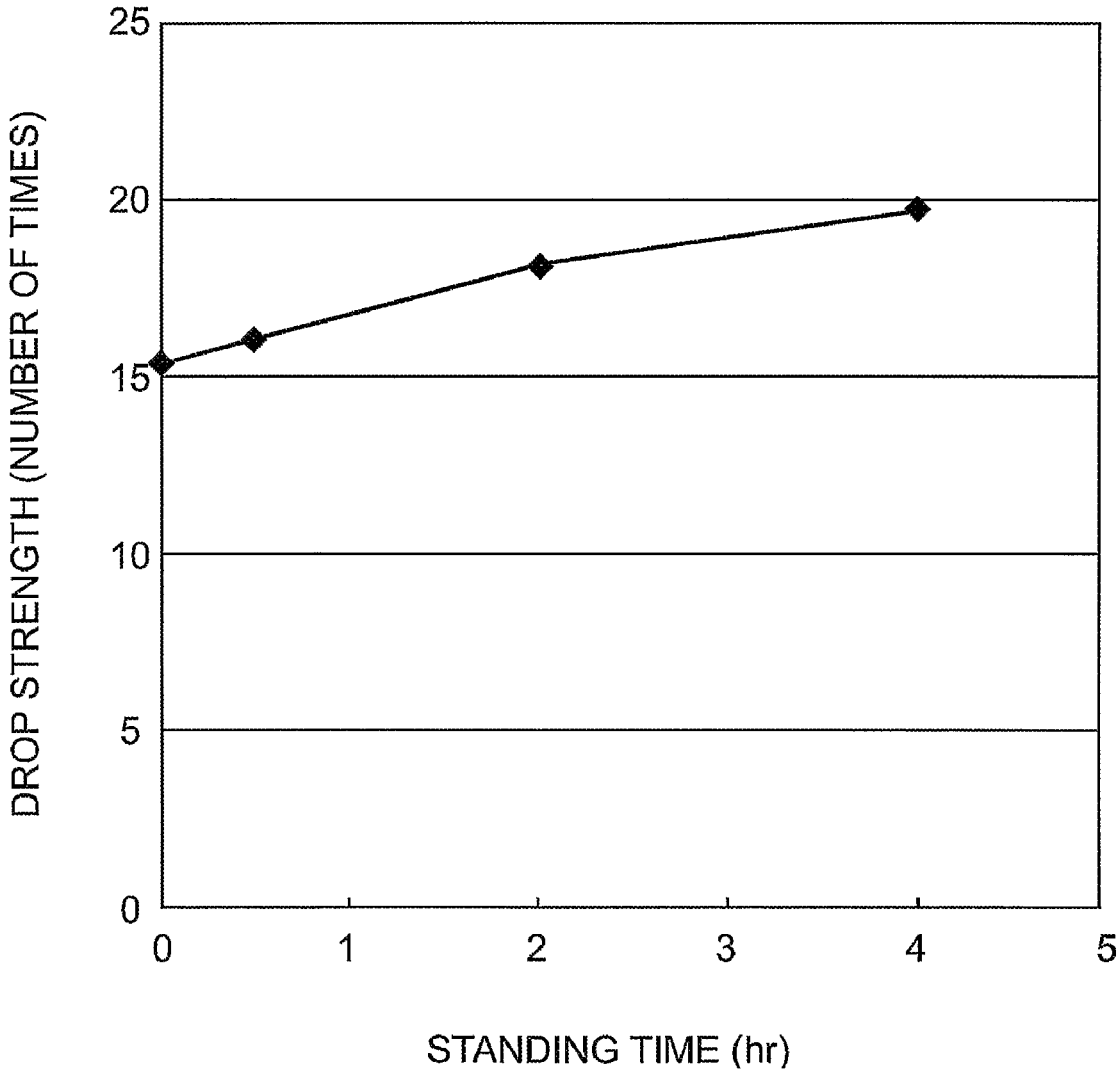
FIG. 1 is a graph showing a relationship between the standing time and the drop strength.

The present inventors have investigated many kinds of binders and their blending amount, moisture content, and so on in order to obtain an agglomerated material having a high strength. As a result, the inventors have found that the strength of the agglomerated material can be significantly increased by using a carbohydrate as the binder that is blended to the material mixture; leaving the material mixture standing for aging prior to the agglomeration of it; and then drying the material mixture. Thus, the present invention has been accomplished. The present invention will now be described.

In the method according to the present invention, a carbohydrate is used as the binder. Since slag is hardly formed even if the carbohydrate is heated, the strength of the agglomerated material can be increased without an increase in slag generation by using the carbohydrate.

The carbohydrate is a compound having an elemental ratio represented by a formula $Cm(H_2O)n$. Examples of the carbohydrate include monosaccharides such as glucose, fructose, mannose, galactose, tagatose, xylose, arabinose, ribulose, xylulose, lyxose, ribose, and deoxyribose; disaccharides such as saccharose, maltose, cellobiose, gentiobiose, melibiose, lactose, turanose, sophorose, trehalose, isotrehalose, and isosaccharose; and polysaccharides such as cellulose, starch (amylose and mylopectin), glycogen, carronin, laminaran, dextran, inulin, levan, mannan, xylan, and gum Arabic. Among these carbohydrates, in particular, polysaccharides have a strong bonding power and exhibit a high enhancing effect in a small amount; hence polysaccharides are preferable. Among the polysaccharides, starch is most preferable. Any starch may be used. Examples of the starch include wheat flour, potato flour, sweet potato flour, corn flour, and tapioca flour.

The blending ratio of the binder is preferably 0.5 percent by mass or more to the material mixture. When the blending ratio is lower than 0.5 percent by mass, the strength of the agglomerated material cannot be sufficiently increased. The blending ratio is more preferably 0.7 percent by mass or more. Higher blending ratio is preferable, but exceeding blending ratio raises manufacturing cost, as described above. Furthermore, it requires raising the moisture content, which causes a decrease in productivity due to extension of the drying time. Therefore, the blending ratio of the binder is preferably about 1.5 percent by mass or less, and more preferably 1.2 percent by mass or less.

The material mixture contains, in addition to the binder, an iron-oxide-containing material, a carbonaceous reducing agent, and moisture.

Any iron-oxide-containing material can be used as long as the material contains iron oxide. Therefore, not only iron ore, which is most commonly used, but also by-product dust and mill scale discharged from an ironworks can be used, for example.

Any carbonaceous reducing agent can be used as long as it can exhibit the reducing activity. Examples of the carbonaceous agent include coal powder that is only treated with pulverization and sieving after mining; pulverized coke after heat treatment such as dry distillation; petroleum coke; and waste plastics. Thus, any carbonaceous reducing agent can be used regardless of their type. For example, blast furnace dust recovered as a waste product containing a carbonaceous material can be also used.

The carbon content of the carbonaceous reducing agent is, but not limited to, preferably 70 percent by mass or more, more preferably 80 percent by mass or more.

The blending ratio of the carbonaceous reducing agent to the material mixture may be preferably equal to or higher than the theoretical equivalent weight necessary for reducing the iron oxide, but not limited to this.

The moisture content blended to the material mixture may be determined so that the material mixture can be agglomerated. For example, the moisture content is about 2 to 15 percent by mass.

The material mixture may further contain dolomite powder, fluorite powder, magnesium powder, silica powder, or limestone powder, as a sub-raw material.

As described above, the strength of the resulting agglomerated material can be increased to a certain extent by blending the carbohydrate as a binder to the material mixture, but it is insufficient. Therefore, in the method according to the present invention, the material mixture containing the carbohydrate as the binder is left to stand for aging prior to the agglomeration. Namely, in a conventional method, an agglomerated material is produced by agglomerating a material mixture immediately after mixing each material and drying it. In the method according to the present invention, the material mixture is left to stand for aging prior to the agglomeration, which is a characteristic point of the present invention. The strength of the agglomerated material is improved by leaving the material mixture standing and then agglomerating and drying the material mixture. Causes of this are not yet clear. However, as shown by the example below, the strength of the agglomerated material is certainly increased by leaving the material mixture standing prior to the agglomeration.

The time for leaving the material mixture standing may be, but not limited to, at least 0.5 hr. When the time is shorter than 0.5 hr, a strength increase caused by leaving the material mixture standing hardly occurs. Therefore, a decrease in production efficiency due to time spending for the standing is larger than a strength increase caused by leaving the material mixture standing. The upper limitation of the time for the standing is not specifically defined, but the production efficiency decreases with an increase in the time. Furthermore, a place for leaving the material mixture standing must be provided. Therefore, the time for the standing is preferably about 4 hr at a maximum from the viewpoint of actual operation.

The temperature when the material mixture is left to stand is, but not limited to, preferably about a room temperature. Higher temperature causes moisture evaporation from the material mixture to inhibit the material mixture from being agglomerated after the standing.

The atmosphere for leaving the material mixture standing may be, but not limited to, the air.

After leaving the material mixture standing, it is agglomerated and dried.

The term agglomeration means the forming of the material mixture into an arbitrary shape, such as block, grain, approximately spherical, briquette, pellet, bar, ellipse, and ovoid-shapes. The agglomeration process is performed by, but not limited to, rolling granulation or pressure forming.

The size of the agglomerated material is, but not limited to, preferably about 3 to 25 mm as an average particle size so that the heat reduction is uniformly performed.

A compact prepared by agglomeration is dried to obtain an agglomerated material. The agglomerated material after the drying is charged onto a hearth of a moving hearth-type reducing furnace and is heated according to conventional processes. Iron oxide in the material mixture is reduced with the carbonaceous reducing agent by heating the material mixture, and metallic iron produced by the reduction is separated from slag generated as a by-product to yield the metallic iron.

The present invention will now be further described in detail with reference to the example, but it should be understood that the example is not intended to limit the invention. On the contrary, any modification in the range of the purpose described above or below is within the technical scope of the present invention.

EXAMPLE

A material mixture, which was composed of 62.0 percent by mass of iron ore powder as an iron-oxide-containing material, 14.6 percent by mass of coal powder as a carbonaceous reducing agent, 1 percent by mass of wheat flour as a binder, 14.3 percent by mass of moisture, and one or more sub-raw material as the balance, was left to stand at room temperature for the time shown in Table 1 below. The material mixture was agglomerated and dried into an agglomerated material. The agglomerated material was approximately spherical. The particle size ranged from 16 mm to 19 mm, and the average particle size was 17.5 mm.

In order to evaluate mechanical strength of the resulting agglomerated material, the drop strength and the crush strength were measured.

The drop strength was determined by measuring the number of times it took until the agglomerated material was broken when subjected to free-fall drops onto a steel plate from a height of 45 cm. Ten samples of the agglomerated material were measured for drop strength and the average number of times calculated from the results of the ten samples was used as the drop strength. Table 1 shows the results. FIG. 1 is a graph showing a relationship between the standing time and the drop strength. Here, the term "broken" means a state in which debris of the agglomerated material having a size of about one fourth or more of the surface area of the agglomerated material was separated.

Figure 2:
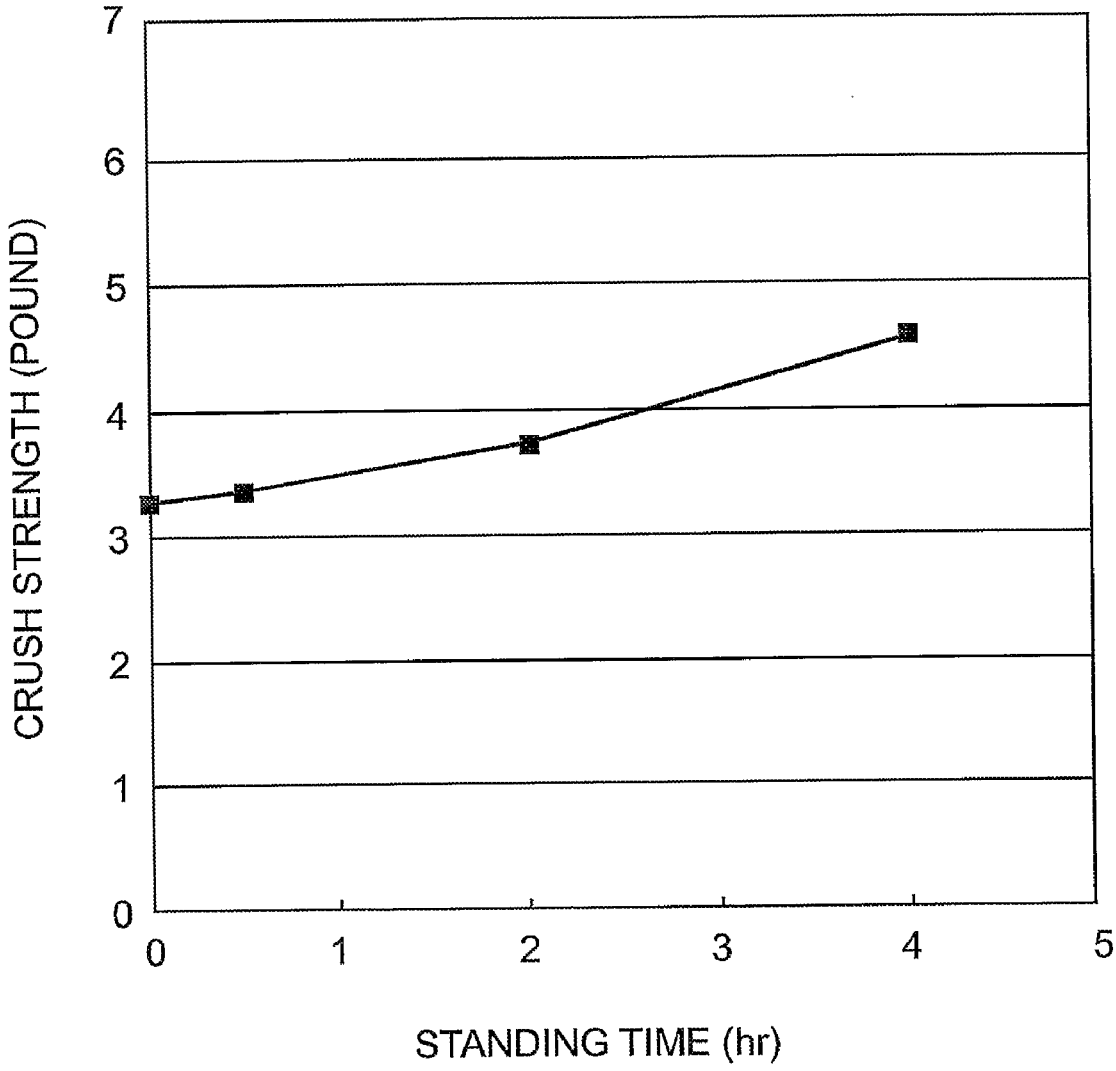
FIG. 2 is a graph showing a relationship between the standing time and the crush strength.

The crush strength was determined by measuring a load (pound) when the agglomerated material was broken using a crush strength analyzer. One agglomerated material at a time was subjected to the measurement, and the average load calculated from the results of ten samples of the agglomerated material was used as the crush strength. Table 1 shows the results. FIG. 2 is a graph showing a relationship between the standing time and the crush strength.

TABLE 1

| No. | Standing Time (hr) | Drop Strength (number of times) | Crush Strength (pound) |
|---|---|---|---|
| 1 | 0 | 15.4 | 3.25 |
| 2 | 0.5 | 16.1 | 3.37 |
| 3 | 2 | 18.2 | 3.75 |
| 4 | 4 | 19.8 | 4.6 |

With reference to Table 1 and FIGS. 1 and 2, it is obvious that the drop strength and the crush strength were improved with an increase in the time for the standing.

The invention claimed is:

1. A method for producing an agglomerated material used for producing metallic iron, wherein the agglomerated material is produced by agglomerating a material mixture containing an iron-oxide-containing material, a carbonaceous reducing agent, a binder, and moisture; drying the material mixture; and charging and heating the material mixture in a moving hearth-type reducing furnace to reduce the iron oxide contained in the material mixture with the carbonaceous reducing agent, wherein a carbohydrate is used as the binder and the material mixture is left to stand for from 0.5 to 4 hours prior to the agglomeration.

2. The method of claim 1, wherein the carbohydrate is a monosaccharide.

3. The method of claim 1, wherein the carbohydrate is a disaccharide.

4. The method of claim 1, wherein the carbohydrate is a polysaccharide.

5. The method of claim 1, wherein the carbohydrate is one or more selected from the group consisting of glucose, fructose, mannose, galactose, tagatose, xylose, arabinose, ribulose, xylulose, lyxose, ribose, deoxyribose, saccharose, maltose, cellobiose, gentiobiose, melibiose, lactose, turanose, sophorose, trehalose, isotrehalose, isosaccharose, cellulose, starch, glycogen, carronin, laminaran, dextran, inulin, levan, mannan, xylan, and gum Arabic.

6. The method of claim 1, wherein the carbohydrate is starch.

7. The method of claim 1, wherein the carbohydrate is wheat flour, potato flour, sweet potato flour, corn flour, or tapioca flour.

8. The method of claim 1, wherein the ratio of the binder to the material mixture is from 0.5 percent by mass to 1.5 percent by mass.

9. The method of claim 1, wherein the ratio of the binder to the material mixture is from 0.7 percent to 1.2 percent by mass.

10. The method of claim 1, wherein the carbonaceous reducing agent has a carbon content of at least 70 percent by mass.

11. The method of claim 1, wherein the carbonaceous reducing agent has a carbon content of at least 80 percent.

12. The method of claim 1, wherein material mixture has a moisture content of about 2 to 15 percent by mass.

13. A method for producing an agglomerated material used for producing metallic iron, the method comprising making a material mixture containing an iron-oxide-containing material, a carbonaceous reducing agent, a carbohydrate binder, and moisture;

leaving the material mixture to stand for from 0.5 to 4 hours;

after the material mixture has stood for from 0.5 to 4 hours, agglomerating the material mixture;

drying the material mixture; and charging and heating the material mixture in a moving hearth-type reducing furnace to reduce the iron oxide contained in the material mixture with the carbonaceous reducing agent.

14. The method of claim 13, wherein the carbohydrate is a monosaccharide.

15. The method of claim 13, wherein the carbohydrate is a disaccharide.

16. The method of claim 13, wherein the carbohydrate is a polysaccharide.

17. The method of claim 13, wherein the carbohydrate is one or more selected from the group consisting of glucose, fructose, mannose, galactose, tagatose, xylose, arabinose, ribulose, xylulose, lyxose, ribose, deoxyribose, saccharose, maltose, cellobiose, gentiobiose, melibiose, lactose, turanose, sophorose, trehalose, isotrehalose, isosaccharose, cellulose, starch, glycogen, carronin, laminaran, dextran, inulin, levan, mannan, xylan, and gum Arabic.

18. The method of claim 13, wherein the carbohydrate is starch.

19. The method of claim 13, wherein the carbohydrate is wheat flour, potato flour, sweet potato flour, corn flour, or tapioca flour.

20. The method of claim 13, wherein the ratio of the binder to the material mixture is from 0.5 percent by mass to 1.5 percent by mass.

21. The method of claim 13, wherein the ratio of the binder to the material mixture is from 0.7 percent to 1.2 percent by mass.

22. The method of claim 13, wherein the carbonaceous reducing agent has a carbon content of at least 70 percent by mass.

23. The method of claim 13, wherein the carbonaceous reducing agent has a carbon content of at least 80 percent.

24. The method of claim 13, wherein material mixture has a moisture content of about 2 to 15 percent by mass.

* * * * *